US012473623B2

(12) United States Patent
Hironaka et al.

(10) Patent No.: US 12,473,623 B2
(45) Date of Patent: Nov. 18, 2025

(54) STEEL SHEET

(71) Applicant: NIPPON STEEL CORPORATION, Tokyo (JP)

(72) Inventors: Satoshi Hironaka, Tokyo (JP); Mai Nagano, Tokyo (JP); Yasuhiro Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 177 days.

(21) Appl. No.: 18/290,465

(22) PCT Filed: Mar. 4, 2022

(86) PCT No.: PCT/JP2022/009304
§ 371 (c)(1),
(2) Date: Nov. 14, 2023

(87) PCT Pub. No.: WO2022/254847
PCT Pub. Date: Dec. 8, 2022

(65) Prior Publication Data

US 2024/0271261 A1 Aug. 15, 2024

(30) Foreign Application Priority Data

May 31, 2021 (JP) ..... 2021-091649

(51) Int. Cl.

| | |
|---|---|
| ***C22C 38/60*** | (2006.01) |
| ***C21D 1/84*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |

(Continued)

(52) U.S. Cl.

CPC ..... *C22C 38/60* (2013.01); *C21D 1/84* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/021* (2013.01); *C21D 8/0226* (2013.01); *C21D 8/0236* (2013.01); *C21D 8/0263* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/005* (2013.01)

(58) Field of Classification Search

CPC . C21D 9/32; C21D 9/085; C21D 9/46; C21D 1/06; C21D 1/84; C21D 6/001; C21D 6/002; C21D 6/004; C21D 6/005; C21D 6/007; C21D 6/008; C21D 8/105; C21D 8/0205; C21D 8/021; C21D 8/0226; C21D 8/0236; C21D 8/0278; C21D 8/1222; C21D 8/005; C21D 1/76; C22C 38/001; C22C 38/002; C22C 38/008; C22C 38/02; C22C 38/04; C22C 38/06; C22C 38/08; C22C 38/12; C22C 38/14; C22C 38/20; C22C 38/22; C22C 38/24; C22C 38/26; C22C 38/28; C22C 38/30; C22C 38/32; C22C 38/38; C22C 38/42; C22C 38/58; C22C 38/60; C23C 8/24; C23C 8/26; C23C 8/30; C23C 8/32; C23C 8/48; C23C 8/54; C23C 8/74; Y02P 10/25; Y10T 428/24942; Y10T 428/24983

USPC ..... 420/8–129; 428/212, 217, 220

See application file for complete search history.

(56) References Cited

U.S. PATENT DOCUMENTS

| | | | | |
|---|---|---|---|---|
| 2014/0193667 | A1 | 7/2014 | Shuto et al. | |
| 2019/0161822 | A1* | 5/2019 | Takashima | C22C 38/08 |
| 2020/0071799 | A1* | 3/2020 | Takeda | C21D 8/0236 |

FOREIGN PATENT DOCUMENTS

| | | | | |
|---|---|---|---|---|
| BR | 112019016852 | A2 * | 4/2020 | C21D 9/46 |
| CA | 2827065 | A1 * | 9/2012 | C22C 38/34 |

(Continued)

*Primary Examiner* — Megha M Gaitonde

(74) *Attorney, Agent, or Firm* — Birch, Stewart, Kolasch & Birch, LLP

(57) ABSTRACT

There is provided a steel sheet that delivers an excellent appearance quality in its formed product. The steel sheet has a chemical composition including, in mass %, C: 0.030% to 0.145%, Si: 0% to 0.500% or less, Mn: 0.50% to 2.50%, P: 0% to 0.100%, S: 0% to 0.020%, Al: 0% to 1.000%, N: 0% to 0.0100%, and the like, wherein a metal micro-structure consists of 70 to 95% ferrite in volume fraction and 5 to 30% hard phases in volume fraction, and a value X1 obtained by dividing a standard deviation of Vickers hardnesses $H_{1/4}$ at ¼ sheet-thickness positions by an average value of the Vickers hardnesses $H_{1/4}$ is 0.025 or less, and a value X2 obtained by dividing a standard deviation of Vickers hardnesses $H_{1/2}$ at a ½ sheet-thickness position by an average Value of the Vickers hardnesses $H_{1/2}$ is 0.030 or less.

9 Claims, No Drawings

(51) Int. Cl.

| | |
|---|---|
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(56) References Cited

FOREIGN PATENT DOCUMENTS

| | | | |
|---|---|---|---|
| EP | 3 173 494 | A1 | 5/2017 |
| JP | 2005-220430 | A | 8/2005 |
| KR | 10-2014-0027526 | A | 3/2014 |

* cited by examiner

STEEL SHEET

TECHNICAL FIELD

The present invention relates to a steel sheet.

BACKGROUND ART

For automobiles, there are increasing needs for weight reduction on not only structural components such as members but also panel components such as a roof or a door outer panel, for the improvement in fuel efficiency from the viewpoint of the conservation of the global environment. Unlike skeleton components, these panel components are required to have high appearance quality because the panel components come to one's notice. The appearance quality can include designability and surface quality.

Patent Document 1 discloses a high-strength galvanized steel sheet that is excellent in surface quality. Specifically, Patent Document 1 discloses a high-strength galvanized steel sheet including a steel sheet (substrate) and hot-dip galvanized layer on a surface of the substrate. The steel sheet (substrate) contains, in mass %, C: 0.02 to 0.20%, Si: 0.7% or less, Mn: 1.5 to 3.5%, P: 0.10% or less, S: 0.01% or less, Al: 0.1 to 1.0%, N: 0.010% or less, and Cr: 0.03 to 0.5%, with the balance being Fe and unavoidable impurities, and makes an in-annealing surface oxidation index A defined by a formula: A=400Al/(4Cr+3Si+6Mn), in which Al, Cr, Si, and Mn indicate their respective contents, be 2.3 or more. Micro-structures of the steel sheet (substrate) consist of ferrite and second phases, and the second phases are mainly of martensite.

LIST OF PRIOR ART DOCUMENT

Patent Document

Patent Document 1: JP2005-220430A

SUMMARY OF INVENTION

Technical Problem

To improve the appearance quality, the prevention of development of ghost lines is a problem. Ghost lines refer to minute projections and depressions that develop on the order of 1 mm on surfaces of a steel sheet that includes hard phases and soft phases, such as of a dual phase (DP) steel, by preferential deformation of peripheries of the soft phases when the steel sheet is subjected to press forming. The projections and depressions develop in streaky lines on the surface, and therefore, a press-formed product with ghost lines developing is poor in appearance quality.

As the panel components are increased in strength and reduced in thickness for the weight reduction of automobiles and are additionally made more complex in shape, a surface of the steel sheet after the forming is liable to projections and depressions, which tends to cause ghost lines to develop.

The present invention has been made in view of the above circumstances. An objective of the present invention is to provide a steel sheet that delivers an excellent appearance quality in its formed product.

Solution to Problem

The present invention has a gist of a steel sheet described below.

(1) A steel sheet including a chemical composition containing, in mass %:

C: 0.030% to 0.145%,
Si: 0% to 0.500%,
Mn: 0.50% to 2.50%,
P: 0% to 0.100%,
S: 0% to 0.020%,
Al: 0% to 1.000%,
N: 0% to 0.0100%,
B: 0% to 0.0050%,
Mo: 0% to 0.80%,
Ti: 0% to 0.200%,
Nb: 0% to 0.10%,
V: 0% to 0.20%,
Cr: 0% to 0.80%,
Ni: 0% to 0.25%,
O: 0% to 0.0100%,
Cu: 0% to 1.00%,
W: 0% to 1.00%,
Sn: 0% to 1.00%,
Sb: 0% to 0.20%,
Ca: 0% to 0.0100%,
Mg: 0% to 0.0100%,
Zr: 0% to 0.0100%, and
REM: 0% to 0.0100%, with the balance being Fe and impurities, wherein a metal micro-structure consists of 70 to 95% ferrite in volume fraction and 5 to 30% hard phases in volume fraction, a value X1 obtained by dividing a standard deviation of Vickers hardnesses $H_{1/4}$ at ¼ sheet-thickness positions by an average value of the Vickers hardnesses $H_{1/4}$ is 0.025 or less, and a value X2 obtained by dividing a standard deviation of Vickers hardnesses $H_{1/2}$ at a ½ sheet-thickness position by an average Value of the Vickers hardnesses $H_{1/2}$ is 0.030 or less.

(2) The steel sheet according to (1) above, wherein an average grain diameter of the ferrite is 5.0 μm to 30.0 μm, and an average grain diameter of the hard phases is 1.0 μm to 5.0 μm.

(3) The steel sheet according to (1) or (2) above, wherein an area of hard phases connected together to extend 100 μm or more in a rolling direction of the steel sheet is 30% or less of an area of all hard phases in a region between a ¼ sheet-thickness position and a ½ sheet-thickness position.

(4) The steel sheet according to any one of (1) to (3) above, wherein an aspect ratio Str (ISO 25178) of surface texture of a specimen of the steel sheet given 5% distortion in a tensile test is 0.28 or more.

(5) The steel sheet according to any one of (1) to (4) above, wherein an average value of Vickers hardnesses $H_{1/4}$ at ¼ sheet-thickness positions is 150 to 300, and an average value of Vickers Hardnesses $H_{1/2}$ at a ½ sheet-thickness position is 155 to 305.

(6) The steel sheet according to any one of (1) to (5) above, wherein the hard phases consist of any one or more of martensite, bainite, tempered martensite, and pearlite.

(7) The steel sheet according to any one of (1) to (6) above, wherein a sheet thickness of the steel sheet is 0.20 mm to 1.00 mm.

(8) The steel sheet according to any one of (1) to (7) above, wherein the steel sheet is an automobile skin panel.

Advantageous Effect of Invention

According to the aspects of the present invention, a steel sheet that delivers an excellent appearance quality in its formed product can be provided.

DESCRIPTION OF EMBODIMENTS

<Circumstances of Conceiving Present Invention>

The present inventors studied a method for preventing ghost lines from developing after subjecting a high-strength steel sheet to press forming. As mentioned above, a steel sheet that includes hard phases and soft phases intermixing, such as dual phase (DP) steel, may deform in forming mainly at peripheries of the soft phases, which causes minute projections and depressions on surfaces of the steel sheet, and thus causes an appearance defect called ghost lines to develop. In the press forming of the steel sheet, the ghost lines develop in a banded shape (band pattern) by such deformation that the soft phases depress while the hard phases do not depress or rather rise to be convex. A banded microstructure is formed in the hard phases such as martensite.

As a result of diligent studies, the present inventors found that the banded hard phases can be reduced in a finished product of a steel sheet by controlling hot-rolled structures to reduce banded microstructures in production of the steel sheet.

The present invention has been made based on the findings. A steel sheet according to the present embodiment will be described below in detail. Note that the present invention is not limited to only the configuration disclosed in the present embodiment. Various modifications may be made without departing from the scope of the present invention.

First, a chemical composition of the steel sheet according to the present embodiment will be described. Each of limited numerical ranges to be described below that are expressed by numerical values with "to" therebetween includes its lower limit value and its upper limit value. Numerical values accompanied by "less than" or "more than" are not included in the numerical ranges. In the following description, percent relating to the chemical composition refers to mass % unless otherwise particularly stated.

A steel sheet according to the present embodiment includes a chemical composition containing in mass %:

C: 0.030% to 0.145%,
Si: 0% to 0.500%,
Mn: 0.50% to 2.50%,
P: 0% to 0.100%,
S: 0% to 0.020%,
Al: 0% to 1.000%,
N: 0% to 0.0100%,
B: 0% to 0.0050%,
Mo: 0% to 0.80%,
Ti: 0% to 0.200%,
Nb: 0% to 0.10%,
V: 0% to 0.20%,
Cr: 0% to 0.80%,
Ni: 0% to 0.25%,
O: 0% to 0.0100%,
Cu: 0% to 1.00%,
W: 0% to 1.00%,
Sn: 0% to 1.00%,
Sb: 0% to 0.20%,
Ca: 0% to 0.0100%,
Mg: 0% to 0.0100%,
Zr: 0% to 0.0100%, and
REM: 0% to 0.0100%,
with the balance being Fe and impurities. The elements will be described below.

(C: 0.030% to 0.145%)

C (carbon) is an element that increases a strength of the steel sheet. To provide a desired strength, the content of C is set to 0.030% or more. To further increase the strength, the content of C is preferably 0.035% or more, more preferably 0.040% or more, further preferably 0.050% or more, and even more preferably 0.060% or more.

By setting the content of C to 0.145% or less, diffusion of Mn is accelerated in solidification. This can suppress the likelihood of occurrence of banded Mn segregation. As a result, the development of ghost lines after press forming of the steel sheet can be prevented. For this reason, the content of C is set to 0.145% or less. The content of C is preferably 0.110% or less, and more preferably 0.090% or less.

(Si: 0% to 0.500%)

Si (silicon) is a deoxidizing element for steel. Si is thus an element that is effective in increasing a strength of the steel sheet without impairing a ductility of the steel sheet. By setting the content of Si to 0.500% or less, a surface defect due to deterioration in scale peeling properties can be prevented from developing. For this reason, the content of Si is set to 0.500% or less. The content of Si is preferably 0.450% or less, more preferably 0.250% or less, and further preferably 0.100% or less.

A lower limit of the content of Si includes 0%. The content of Si may be however set to 0.0005% or more or 0.0010% or more, more preferably more than 0.090%, and further preferably 0.100% or more to improve a strength-formability balance of the steel sheet.

(Mn: 0.50% to 2.50%)

Mn (manganese) is an element that increases a hardenability of steel, contributing to improvement in a strength of steel. To provide a desired strength, the content of Mn is set to 0.50% or more. The content of Mn is preferably 1.20% or more, more preferably 1.40% or more, further preferably more than 1.60%, and even more preferably 1.65% or more.

When the content of Mn is 2.50% or less, banded Mn segregation can be prevented from occurring when the steel is solidified. For this reason, the content of Mn is set to 2.50% or less. The content of Mn is preferably 2.25% or less, more preferably 2.00% or less, and further preferably 1.80% or less.

(P: 0% to 0.100%)

P (phosphorus) is an element that embrittles steel. When the content of P is 0.100% or less, the resultant steel sheet can be prevented from being embrittled to easily crack in a manufacturing process. For this reason, the content of P is set to 0.100% or less. The content of P is preferably 0.080% or less, and more preferably 0.050% or less.

A lower limit of the content of P includes 0%. However, by setting the content of P to 0.001% or more, production costs can be further reduced. For this reason, the content of P may be set to 0.001% or more.

(S: 0% to 0.020%)

S (sulfur) is an element that forms Mn sulfide, thus degrading formabilities of the steel sheet such as ductility, hole-expansion properties, stretch flangeability, and bendability. When the content of S is 0.020% or less, the formabilities of the steel sheet can be prevented from significantly deteriorating. For this reason, the content of S is set to 0.020% or less. The content of S is preferably 0.010% or less, and more preferably 0.008% or less.

A lower limit of the content of S includes 0%. However, by setting the content of S to 0.0001% or more, production costs can be further reduced. For this reason, the content of S may be set to 0.0001% or more.

(Al: 0% to 1.000%)

Al (aluminum) is an element that functions as a deoxidizer. Thus, Al is an element that is effective in increasing a strength of steel. By setting the content of Al to 1.000% or less, castability can be increased, and thus productivity can be increased. For this reason, the content of Al is set to 1.000% or less. The content of Al is preferably 0.650% or less, more preferably 0.600% or less, and further preferably 0.500% or less.

A lower limit of the content of Al includes 0%. However, the content of Al may be set to 0.005% or more to sufficiently provide the deoxidation effect by Al.

(N: 0% to 0.0100%)

N (nitrogen) is an element that forms nitrides, thus degrading formabilities of the steel sheet such as ductility, hole-expansion properties, stretch flangeability, and bendability. When the content of N is 0.0100% or less, the formabilities of the steel sheet can be prevented from deteriorating. For this reason, the content of N is set to 0.0100% or less. N is also an element that causes a weld defect to develop during welding, thus hindering productivity. For this reason, the content of N is preferably 0.0080% or less, more preferably 0.0070% or less, and further preferably 0.0040% or less.

A lower limit of the content of N includes 0%. However, by setting the content of N to 0.0005% or more, production costs can be further reduced. For this reason, the content of N may be set to 0.0005% or more.

The steel sheet according to the present embodiment may contain the following elements as optional elements. For each of the optional elements, when the optional element is not contained, the content of the optional element is 0%.

(B: 0% to 0.0050%)

B (boron) is an element that prevents phase transformation at high temperature, thus contributing to improvement in a strength of the steel sheet. B need not necessarily be contained. Therefore, a lower limit of the content of B includes 0%. To sufficiently provide the advantageous effect of improving strength by B, the content of B is preferably 0.0001% or more, more preferably 0.0005% or more, and further preferably 0.0010% or more.

When the content of B is 0.0050% or less, deterioration in the strength of the steel sheet due to production of B precipitates can be prevented. For this reason, the content of B is set to 0.0050% or less, and preferably 0.0030% or less. The content of B may be 0.0001% to 0.0050%.

(Mo: 0% to 0.80%)

Mo (molybdenum) is an element that prevents phase transformation at high temperature, thus contributing to improvement in a strength of the steel sheet. Mo need not necessarily be contained. Therefore, a lower limit of the content of Mo includes 0%. To sufficiently provide the advantageous effect of improving strength by Mo, the content of Mo is preferably 0.001% or more, more preferably 0.05% or more, and further preferably 0.10% or more.

Further, when the content of Mo is 0.80% or less, decrease in productivity due to deterioration in hot workability can be prevented. For this reason, the content of Mo is set to 0.80% or less. The content of Mo is preferably 0.40% or less, and more preferably 0.20% or less. The content of Mo may be 0.001% to 0.80% or may be 0% to 0.40%

When Cr and Mo are both contained, and the contents of Cr and Mo are set such that Cr: 0.20% to 0.80% and Mo: 0.05% to 0.80%, a strength of the steel sheet can be improved more reliably, which is preferable.

(Ti: 0% to 0.200%)

Ti (titanium) is an element that has an effect of reducing amounts of S, N, and O (oxygen), which produce coarse inclusions serving as an origin of fracture. Ti also has an effect of refining micro-structures, thus increasing a strength-formability balance of the steel sheet. Ti need not necessarily be contained. Therefore, a lower limit of the content of Ti includes 0%. To sufficiently provide the effects, the content of Ti is preferably set to 0.001% or more, and more preferably set to 0.010% or more.

When the content of Ti is 0.200% or less, formation of coarse Ti sulfide, Ti nitride, and Ti oxide can be prevented, which enables the steel sheet to keep its formabilities. For this reason, the content of Ti is set to 0.200% or less. The content of Ti is preferably set to 0.080% or less, and more preferably set to 0.060% or less. The content of Ti may be 0% to 0.100% or may be 0.001% to 0.200%.

(Nb: 0% to 0.10%)

Nb (niobium) is an element that brings about strengthening with its precipitates, grain refinement strengthening by preventing growth of ferrite grains, and dislocation strengthening by preventing recrystallization, thus contributing to improvement in a strength of the steel sheet. Nb need not necessarily be contained. Therefore, a lower limit of the content of Nb includes 0%. To sufficiently provide the effect, the content of Nb is preferably set to 0.001% or more, more preferably set to 0.005% or more, and further preferably set to 0.01% or more.

When the content of Nb is 0.10% or less, recrystallization is promoted, which can prevent unrecrystallized ferrite from remaining, thus enabling the steel sheet to keep its formabilities. For this reason, the content of Nb is set to 0.10% or less. The content of Nb is preferably 0.05% or less, and more preferably 0.04% or less. The content of Nb may be 0.001% to 0.10%.

(V: 0% to 0.20%)

V (vanadium) is an element that brings about strengthening with its precipitates, grain refinement strengthening by preventing growth of ferrite grains, and dislocation strengthening by preventing recrystallization, thus contributing to improvement in a strength of the steel sheet. V need not necessarily be contained. Therefore, a lower limit of the content of V includes 0%. To sufficiently provide the advantageous effect of improving strength by V, the content of V is preferably 0.001% or more, more preferably 0.01% or more, and further preferably 0.03% or more.

When the content of V is 0.20% or less, deterioration in the formabilities of the steel sheet due to an abundance of precipitation of its carbo-nitride can be prevented. For this reason, the content of V is set to 0.20% or less. The content of V is preferably 0.10% or less. The content of V may be 0% to 0.10% or may be 0.001% to 0.20%.

(Cr: 0% to 0.80%)

Cr (chromium) is an element that increases a hardenability of steel, thus contributing to improvement in a strength of the steel sheet. Cr need not necessarily be contained. Therefore, a lower limit of the content of Cr includes 0%. To sufficiently provide the advantageous effect of improving strength by Cr, the content of Cr is preferably 0.001% or more, further preferably 0.20% or more, and particularly preferably 0.30% or more.

When the content of Cr is 0.80% or less, formation of coarse Cr carbide, which can serve as an origin of fracture, can be prevented. For this reason, the content of Cr is set to 0.80% or less. The content of Cr is preferably 0.70% or less, and more preferably 0.50% or less. The content of Cr may be 0% to 0.70% or may be 0.001% to 0.80%.

(Ni: 0% to 0.25%)

Ni (nickel) is an element that prevents phase transformation at high temperature, thus contributing to improvement in a strength of the steel sheet. Ni need not necessarily be contained. Therefore, a lower limit of the content of Ni includes 0%. To sufficiently provide the advantageous effect of improving strength by Ni, the content of Ni is preferably 0.001% or more, and more preferably 0.05% or more.

When the content of Ni is 0.25% or less, deterioration in a weldability of the steel sheet can be prevented. For this reason, the content of Ni is set to 0.25% or less. The content of Ni is preferably 0.20% or less, and more preferably 0.15% or less. The content of Ni may be 0.001% to 0.20%.

Preferable contents of O, Cu, W, Sn, Sb, Ca, Mg, Zr, and REM as optional additive elements will be described below. Note that none of these O, Cu, W, Sn, Sb, Ca, Mg, Zr, and REM contribute to reduction of ghost lines when contained within the respective content ranges exemplified below. In other words, in the present embodiment, O, Cu, W, Sn, Sb, Ca, Mg, Zr, and REM have no influence on the effect of decreasing an anisotropy of projections and depressions on the surface after the forming resulting from reduction of connected hard phases, which is brought by application of heavy reduction in second half stand, in which a rolling reduction is increased in a second half of finish rolling of a hot rolling step described later.

(O: 0% to 0.0100%)

O (oxygen) is an element that is mixed into in a production process for the steel sheet. The content of O may be 0%. By setting the content of O to 0.0001% or more, a refining time can be shortened, and thus productivity can be increased. The content of O therefore may be 0.0001% or more, 0.0005% or more, or 0.0010% or more. At the same time, when the content of O is 0.0100% or less, formation of coarse oxides can be prevented, which can increase formabilities of the steel sheet such as ductility, hole-expansion properties, stretch flangeability, and/or bendability. The content of O is therefore set to 0.0100% or less. The content of O may be 0.0070% or less, 0.0040% or less, or 0.0020% or less.

(Cu: 0% to 1.00%)

Cu (copper) is an element that is present in the form of fine particles in steel, contributing to improvement in a strength of the steel sheet. The content of Cu may be 0%. However, the content of Cu is preferably 0.001% or more to provide such an effect. The content of Cu may be 0.01% or more, 0.03% or more, or 0.05% or more. In contrast, by setting the content of Cu to 1.00% or less, a weldability of the steel sheet can be made satisfactory. The content of Cu is therefore set to 1.00% or less. The content of Cu may be 0.60% or less, 0.40% or less, or 0.20% or less.

(W: 0% to 1.00%)

W (tungsten) is an element that prevents phase transformation at high temperature, thus contributing to improvement in a strength of the steel sheet. The content of W may be 0%. However, the content of W is preferably 0.001% or more to provide such an effect. The content of W may be 0.01% or more, 0.02% or more, or 0.10% or more. In contrast, by setting the content of W to 1.00% or less, hot workability can be increased, and thus productivity can be increased. The content of W is therefore set to 1.00% or less. The content of W may be 0.80% or less, 0.50% or less, or 0.20% or less.

(Sn: 0% to 1.00%)

Sn (tin) is an element that prevents grains from coarsening, thus contributing to improvement in a strength of the steel sheet. The content of Sn may be 0%. However, the content of Sn is preferably 0.001% or more to provide such an effect. The content of Sn may be 0.01% or more, 0.05% or more, or 0.08% or more. In contrast, by setting the content of Sn to 1.00% or less, embrittlement of the steel sheet can be prevented. The content of Sn is therefore set to 1.00% or less. The content of Sn may be 0.80% or less, 0.50% or less, or 0.20% or less.

(Sb: 0% to 0.20%)

Sb (antimony) is an element that prevents grains from coarsening, thus contributing to improvement in a strength of the steel sheet. The content of Sb may be 0%. However, the content of Sb is preferably 0.001% or more to provide such an effect. The content of Sb may be 0.01% or more, 0.05% or more, or 0.08% or more. In contrast, by setting the content of Sb to 0.20% or less, embrittlement of the steel sheet can be prevented. The content of Sb is therefore set to 0.20% or less. The content of Sb may be 0.18% or less, 0.15% or less, or 0.12% or less.

(Ca: 0% to 0.0100%)

(Mg: 0% to 0.0100%)

(Zr: 0% to 0.0100%)

(REM: 0% to 0.0100%)

Ca (calcium), Mg (magnesium), Zr (zirconium), and REM (rare earth metal) are elements that contribute to improvement in formabilities of the steel sheet. Contents of Ca, Mg, Zr, and REM each may be 0%. However, the contents of Ca, Mg, Zr, and REM are each preferably 0.0001% or more or may be 0.0005% or more, 0.0010% or more, or 0.0015% or more to provide such an effect. In contrast, by setting each of the contents of Ca, Mg, Zr, and REM to 0.0100% or less, a ductility of the steel sheet can be kept. Therefore, the contents of Ca, Mg, Zr, and REM are each set to 0.0100% or less or may be 0.0080% or less, 0.0060% or less, or 0.0030% or less. REM is herein a generic term for 17 elements consisting of scandium (Sc) with atomic number 21, yttrium (Y) with atomic number 39, and lanthanoid, which includes lanthanum (La) with atomic number 57 through lutetium (Lu) with atomic number 71. The content of REM is a total content of these elements.

The balance of the chemical composition of the steel sheet according to the present embodiment may be Fe (iron) and impurities. Examples of the impurities include those mixed from row materials of steel or scrap and/or mixed into in a steel-making process and include elements that are allowed to be contained within their respective ranges within which features of the steel sheet according to the present embodiment are not hindered. Examples of the impurities include H, Na, Cl, Co, Zn, Ga, Ge, As, Se, Tc, Ru, Rh, Pd, Ag, Cd, In, Te, Cs, Ta, Re, Os, Ir, Pt, Au, Pb, Bi, and Po. The impurities may be contained at 0.200% or less in total.

The chemical composition of the steel sheet is to be measured by a common analysis method. For example, the chemical composition is to be measured by inductively coupled plasma-atomic emission spectrometry (ICP-AES). For the measurement of C and S, the infrared absorptiometry after combustion is to be used, and for the measurement of N, the inert gas fusion-thermal conductivity method is to be used. In a case where the steel sheet includes plating layers on its surfaces, the plating layers on the surfaces are to be removed by mechanical grinding before the analysis of the chemical composition.

(Metal Micro-Structures Consisting of 70 to 95% Ferrite in Volume Fraction and 5 to 30% Hard Phases in Volume Fraction)

By setting a volume fraction of hard phases in metal micro-structures of the steel sheet to 5% or more, a strength of the steel sheet can be improved sufficiently. For this reason, the volume fraction of the hard phases is set to 5% or more. In contrast, by setting the volume fraction of the hard phases to 30% or less, the hard phases can be dispersed more uniformly. Therefore, projections and depressions on a surface that develop in forming can be reduced, and appearance of the steel sheet after the forming can be improved.

The balance of the metal micro-structures, other than the hard phases, is ferrite, and a volume fraction of the ferrite is 70 to 95%. The volume fraction of the ferrite is preferably 72% or more, and more preferably 75% or more. The volume fraction of the hard phases is preferably 28% or less, and more preferably 25% or less. A total of the volume fractions of the ferrite and the hard phases in the metal micro-structures is 100%.

In the steel sheet according to the present embodiment, the hard phases are hard structures harder than ferrite. For example, the hard phases consist of any one or more of martensite, bainite, tempered martensite, and pearlite. From the point of improving the strength, the hard phases preferably consist of one or more of martensite, bainite, and tempered martensite, and more preferably consist of martensite.

The volume fraction of the hard phases in the metal micro-structures can be determined by the following method.

A sample (having a size that is roughly 20 mm in a rolling direction×20 mm in a width direction×a thickness of the steel sheet) for the observation of metal micro-structures (microstructures) is extracted from a W/4 position or a 3W/4 position of a sheet width W of the resultant steel sheet (i.e., a W/4 position in the width direction from any one of edge portions of the steel sheet in the width direction). The sample is then subjected to the observation of metal micro-structures (microstructures) at a position of a ½ sheet thickness from a surface of the sample under an optical microscope. An area fraction of hard phases from a surface (in the case where the steel sheet is plated, the surface from which a plating layer is removed) to a ½ sheet thickness of the steel sheet is calculated. For preparation of the sample, a sheet-thickness section in a direction perpendicular to the rolling direction is used as an observation surface, polished, and etched with LePera etchant.

From an optical microscope photograph at a magnification of ×500 or ×1000, "microstructures" are sorted out. In an observation under an optical microscope after LePera etching, structures are observed in different colors such as black for bainite and pearlite, white for martensite (including tempered martensite), and gray for ferrite. Therefore, a distinction between ferrite and other hard structures can be made easily. In an optical microscope photograph, regions having colors other than gray indicating ferrite are hard phases.

In a region from a surface of the steel sheet etched with the LePera etchant to a ½ sheet-thickness position in the sheet thickness direction, the observation is performed on ten visual fields at a magnification of ×500 or ×1000, and image analysis is performed with image analysis software "Photoshop CS5" manufactured by Adobe Inc., to determine area fractions of the hard phases. An example of a technique of the image analysis is such that a maximum luminance value $L_{max}$ and a minimum luminance value $L_{min}$ of each image are obtained from the image, portions including picture elements having luminances from $L_{max}-0.3(L_{max}-L_{min})$ to $L_{max}$ are defined as white regions, portions including picture elements having luminances from $L_{min}$ to $L_{min}+0.3(L_{max}-L_{min})$ are defined as black regions, other portions are defined as gray regions, and the area fractions of the hard phases, which are regions other than the gray regions, is calculated. The ten visual fields in total for the observation are subjected to the same image analysis as described above to measure the area fractions of the hard phases, the area fractions are averaged to calculate an average value, and the average value is taken as the volume fraction.

(Value X1 Obtained by Dividing Standard Deviation $\sigma_{1/4}$ of Vickers Hardnesses $H_{1/4}$ at ¼ Sheet-Thickness Positions by Average Value $H_{AVE1/4}$ of Vickers Hardnesses $H_{1/4}$ is 0.025 or Less)

The present inventors found that when a Vickers hardness distribution of a steel sheet is highly imbalanced, the hard phases are easily connected together into banded shapes, and as a result, ghost lines tend to develop in a formed product produced by performing press forming on the steel sheet. The present inventors paid attention particularly to an imbalance in a Vickers hardness distribution in a region in a steel sheet that is relatively close to a surface of the steel sheet. The present inventors discovered that ghost lines are disconnectedly formed at a location where an imbalance in its Vickers hardness distribution in a rolling direction of the steel sheet is small, which enables prevention of an appearance defect attributable to long-length ghost lines. As a result, the present inventors discovered that bringing a value X1, which is obtained by dividing a standard deviation $\sigma_{1/4}$ of Vickers hardnesses $H_{1/4}$ at ¼ sheet-thickness positions by an average value $H_{AVE1/4}$ of the Vickers hardnesses $H_{1/4}$, to 0.025 or less is effective in increasing a surface quality of surfaces of a steel sheet and a surface quality of surfaces of a formed product produced by performing press forming on the steel sheet.

Note that, in the present embodiment, the Vickers hardness refers to a hardness measured in conformity to JIS Z 2244: 2009, Vickers hardness test—Test method. Here, the Vickers hardness is HV 0.2, a Vickers hardness when a test force is 1.9614 N (0.2 kgf).

In the present embodiment, a subject of the observation of the Vickers hardnesses is a section parallel to the sheet thickness direction and the rolling direction (a section perpendicular to the width direction) of the steel sheet, and the section is at a center of the steel sheet in the width direction.

The observation at the "¼ sheet-thickness positions" refers to an observation in which 50 measurement points are set at 150 μm pitch in the rolling direction at a ¼ position from a front surface of the steel sheet in the sheet thickness direction, and in which 50 measurement points are set at 150 μm pitch in the rolling direction at a ¼ position from a back surface of the steel sheet in the sheet thickness direction. By setting the subject of the observation over a length of 150 μm×50=7.5 mm in the rolling direction in this manner, the Vickers hardnesses can be measured at both locations where ghost lines develop and locations where no ghost lines develop. That is, setting a sufficient length in the rolling direction for the subject of the observation prevents such inconvenience that the measurement is performed on only locations where no ghost lines are produced and prevents the measurement from being performed on only ghost lines.

Thus, a surface quality can be determined more accurately, with consideration given to the presence or absence of ghost lines.

Note that the subject of the observation at the ¼ sheet-thickness positions need not be set in the manner described above. The pitch in the rolling direction on the subject of the observation may be less than 150 μm or may be more than 150 μm. However, an upper limit of the pitch in the rolling direction is set to 400 μm, and a lower limit of the pitch in the rolling direction is set to 50 μm. In addition, the number of the measurement points in the rolling direction may be less than 50 or may be more than 50. However, a lower limit of the number of the measurement points in the rolling direction is set to 30. The length of the subject of the observation in the rolling direction is preferably 5 mm or more for a more accurate determination of surface quality in which consideration is given to positions where ghost lines are present and positions where ghost lines are absent. In the present embodiment, a description will be given of a configuration on the section at the center of the steel sheet in the width direction, but the configuration is not necessarily as such. It suffices that at least one of intermediate sections of the steel sheet in the width direction include a configuration that is the same as the configuration on the section to be described.

As to how to prevent ghost lines from developing in a press-formed product, the present inventors found that the development of ghost lines can be prevented by reducing the imbalance in a Vickers hardness distribution in the rolling direction in the vicinity of a surface of the steel sheet, specifically, by setting the value X1 to 0.025 or less. For this reason, the value X1 is set to 0.025 or less in the present embodiment. The value X1 is preferably 0.020 or less. Note that a lower limit of the value X1 is 0.

(Value X2 Obtained by Dividing Standard Deviation $\sigma_{1/2}$ of Vickers Hardnesses $H_{1/2}$ at ½ Sheet-Thickness Position by Average Value $H_{AVE1/2}$ of Vickers Hardnesses $H_{1/2}$ is 0.030 or Less)

As mentioned above, when the value X1 is 0.025 or less, the development of ghost lines in a formed product produced by performing the press forming on the steel sheet can be prevented. The present inventors also paid attention to an imbalance in a Vickers hardness distribution at a deep region from a front surface of a steel sheet. As a result, the present inventors discovered that bringing a value X2, which is obtained by dividing a standard deviation $\sigma_{1/2}$ of Vickers hardnesses $H_{1/2}$ at a ½ sheet-thickness position by an average value $H_{AVE1/2}$ of the Vickers hardnesses $H_{1/2}$, to 0.030 or less is effective in further increasing a surface quality of surfaces of a steel sheet and a surface quality of surfaces of a formed product produced by performing press forming on the steel sheet.

In the present embodiment, the observation at the "½ sheet-thickness position" refers to an observation in which 50 measurement points are set at 150 μm pitch in the rolling direction at a ½ position from a surface of the steel sheet in the sheet thickness direction. The observation at the "½ sheet-thickness position" and the observation at the "¼ sheet-thickness positions" are the same in detail except that locations of observation differ in position in the sheet thickness direction.

As to how to prevent ghost lines from developing in a press-formed product much more reliably, the present inventors found that the development of ghost lines can be prevented by reducing the imbalance in a Vickers hardness distribution in the rolling direction at a center of the steel sheet, specifically, by setting the value X2 to 0.030 or less. For this reason, the value X2 is set to 0.030 or less in the present embodiment. The value X2 is preferably 0.025 or less. Note that a lower limit of the value X2 is 0.

(Average Grain Diameter of Ferrite is 5.0 to 30.0 μm)

When an average grain diameter of the ferrite is 30.0 μm or less, deterioration in appearance after forming can be prevented. For this reason, it is preferable that the average grain diameter of the ferrite be set to 30.0 μm or less. The average grain diameter is more preferably set to 15.0 μm or less.

In contrast, when the average grain diameter of the ferrite is 5.0 μm or more, particles of the ferrite having the {001} orientation can be prevented from being produced in the form of their agglomerate. Even if individual particles having the {001} orientation of the ferrite are small, when these particles are produced in the form of their agglomerate, deformation is concentrated on a portion of the agglomerate. Therefore, by preventing these particles from agglomerating, the deterioration in appearance after forming can be prevented. For this reason, it is preferable to set an average grain diameter of the ferrite to 5.0 μm or more. The average grain diameter is more preferably 8.0 μm or more, further preferably 10.0 μm or more, and further more preferably 15.0 μm.

The average grain diameter of the ferrite in the steel sheet can be determined by the following method. Specifically, in a region from a surface of the steel sheet etched with LePera etchant to the ½ sheet-thickness position in the sheet thickness direction, observation is performed on ten visual fields at a magnification of ×500, and image analysis is performed with the image analysis software "Photoshop CS5" manufactured by Adobe Inc., in the same manner as described above to calculate area fractions made up by the ferrite and the numbers of particles of the ferrite. The area fractions are totalized, and the numbers of particles are totalized. The totalized area fraction made up by the ferrite is divided by the totalized number of particles of the ferrite to calculate an average area fraction per ferrite particle. From the average area fraction and the number of particles, an equivalent circle diameter is calculated. The resultant equivalent circle diameter is taken as the average grain diameter of the ferrite.

(Average Grain Diameter of Hard Phases is 1.0 to 5.0 μm)

When an average grain diameter of the hard phases is 5.0 μm or less, deterioration in appearance after forming can be prevented. For this reason, it is preferable to set a preferable average grain diameter of the hard phases in the steel sheet to 5.0 μm or less. The average grain diameter is more preferably set to 4.5 μm or less, and further preferably set to 4.0 μm or less.

In contrast, when the average grain diameter of the hard phases is 1.0 μm or more, particles of the hard phases can be prevented from being produced in the form of their agglomerate. By making individual particles of the hard phases small and preventing these particles from agglomerating, the deterioration in appearance after forming can be prevented. For this reason, it is preferable to set the average grain diameter of the hard phases in the steel sheet to 1.0 μm or more. The average grain diameter is more preferably 1.5 μm or more, and further preferably 2.0 μm or more.

The average grain diameter of the hard phases can be determined by the following method. Specifically, in a region from a surface of the steel sheet etched with LePera etchant to the ½ sheet-thickness position in the sheet thickness direction, observation is performed on ten visual fields at a magnification of ×500, and image analysis is performed with the image analysis software "Photoshop CS5" manufactured by Adobe Inc., in the same manner as described above to calculate area fractions made up by the hard phases and the numbers of particles of the hard phases. The area fractions are totalized, and the numbers of particles are totalized. The totalized area fraction made up by the hard phases is divided by the totalized number of particles of the hard phases to calculate an average area fraction per hard phase particle. From the average area fraction and the number of particles, an equivalent circle diameter is calculated. The resultant equivalent circle diameter is taken as the average grain diameter of the hard phases.

(Area of Hard Phases Connected Together to Extend 100 μm or More in Rolling Direction is 30% or Less of Area of all Hard Phases in Region Between ¼ Sheet-Thickness Position and ½ Sheet-Thickness Position)

When an area of hard phases that are connected together to extend 100 μm or more in the rolling direction is 30% or less of an area of all hard phases, convex deformation of hard phases and concave deformation of soft phases around the hard phases are prevented from running long in performing the press forming on the steel sheet. Thus, ghost lines that are easy to visually recognize can be prevented from developing. It is therefore preferable in the present embodiment that the area of hard phases connected together to extend 100 μm or more in the rolling direction be 30% or less of the area of all hard phases in the region between the ¼ sheet-thickness position and the ½ sheet-thickness position. The proportion is more preferably 20% or less. A lower limit of the proportion is 0%.

A method for measuring the proportion in the present embodiment is as follows. First, an observation zone (a connected hard phase observation zone) that is in a region between the ¼ sheet-thickness position and the ½ sheet-thickness position from a surface of the steel sheet in the sheet thickness direction and extends 400 μm in the rolling direction is specified in a section of the steel sheet that is parallel to the sheet thickness direction and the rolling direction and is at the center of the steel sheet in the width direction. Note that a length of the connected hard phase observation zone in the rolling direction may be less than 400 μm (e.g., 300 μm) or may take a value of more than 400 μm (e.g., 500 μm). Note that a lower limit of the length of the connected hard phase observation zone in the rolling direction is set to 250 μm.

Next, in the connected hard phase observation zone, an area AR1 of the hard phases that are connected together to extend 100 μm or more in the rolling direction is measured. Specifically, in the connected hard phase observation zone, the hard phases connected together to extend 100 μm or more in the rolling direction are extracted by image processing according to the method for measuring the hard phases. In this case, the word "connected" indicates that crystal grain boundaries of the hard phases adjoin one another. Next, in the connected hard phase observation zone, an area AR2 of all hard phases is measured according to the method for measuring the hard phases. Then, AR1/AR2 is calculated.

(Aspect Ratio Str (ISO 25178) of Surface Texture of Specimen of the Steel Sheet Having been Given 5% Distortion in Tensile Test is 0.28 or More)

An aspect ratio Str of surface texture of a specimen that has been given 5% distortion in a tensile test (hereinafter, referred to as a "tensile-tested specimen") is an index that indicates an anisotropy of projections and depressions on a surface of a formed product that is obtained by forming (e.g., press forming) a steel sheet. The aspect ratio Str is defined in ISO (International Organization for Standardization) 25178 and is a numerical value between 0 to 1. The closer to 0 an aspect ratio Str is, the larger the anisotropy is. When the anisotropy is large, there is a streak on a surface in an observation zone. In contrast, an aspect ratio Str closer to 1 indicates that a surface shape in an observation zone has no directional dependence.

For example, in a case where a surface in an observation zone has a plurality of convex shapes that extend in a predetermined first direction and have small heights, and the convex shapes are arranged along a second direction perpendicular to the first direction, a surface shape of the surface viewed from the first direction and a surface shape of the surface viewed in the second direction highly differ in regularity. In such a case, the surface shape viewed from the first direction and the surface shape viewed from the second direction highly differs to have a large anisotropy, resulting in an aspect ratio Str taking a value close to 0. In contrast, in a case where a surface of a tensile-tested specimen has no directivity in a projection-depression shape and thus has no convex shapes or concave shapes that extend long in one direction, its aspect ratio Str takes a value close to 1. To improve a surface quality of a surface of a formed product, it is preferable that a surface of a tensile-tested specimen have a large aspect ratio Str, thus having a small anisotropy in surface shape. Thus, an aspect ratio Str of surface texture in a tensile-tested specimen is preferably 0.28 or more. When the aspect ratio Str of the tensile-tested specimen is 0.28 or more, ghost lines on a surface of a formed product are not excessively long. Therefore, a degree of deterioration in surface quality due to ghost lines can be decreased. The aspect ratio Str of the tensile-tested specimen is preferably 0.30 or more, more preferably 0.35 or more.

A method for measuring the aspect ratio Str of a tensile-tested specimen in the present embodiment is as follows. Specifically, a JIS No. 5 test coupon is cut in a direction (width direction) perpendicular to a rolling direction of the steel sheet at a ¼ position from an end of the steel sheet in a sheet width direction, and a surface of the test coupon is brought into a mirror surface condition by polishing the surface with polishing paper. Next, the test coupon is subjected to a tensile test, being given the 5% distortion. Projections and depressions on a surface of the test coupon given the 5% distortion are measured under a laser microscope. From a result of the measurement, the aspect ratio Str is calculated. The aspect ratio Str can be calculated in conformance with ISO 25178 by processing, with analysis software, coordinate data on a surface shape obtained with the laser microscope. In the analysis, no S-filter was used, and an L-filter was set to 0.8 mm.

(Average Value $H_{AVE1/4}$ of Vickers Hardnesses $H_{1/4}$ at ¼ Sheet-Thickness Positions is 150 to 300)

When an average value $H_{AVE1/4}$ of Vickers hardnesses $H_{1/4}$ at ¼ sheet-thickness positions is 150 or more, the steel sheet can provide a tensile strength of 540 MPa or more. When the average value $H_{AVE1/4}$ of the Vickers hardnesses $H_{1/4}$ at the ¼ sheet-thickness positions is 300 or less, the steel sheet is not excessively hardened at the ¼ sheet-thickness positions of the steel sheet, thus sufficiently exerting an effect of smoothing projections and depressions on surfaces of the steel sheet in rolling of the steel sheet.

The Vickers hardness in the present embodiment refers to a hardness that is measured in conformity to JIS Z 2244: 2009, Vickers hardness test—Test method. The average value $H_{AVE1/4}$ of the Vickers hardnesses $H_{1/4}$ at the ¼ sheet-thickness positions can be measured by the following method. At each of ¼ positions in the sheet thickness direction from a front surface and a back surface of the steel sheet, the Vickers hardnesses $H_{1/4}$ are measured at 50 points, 100 points in total, in the rolling direction at 150 μm pitch, and an average value of the Vickers hardnesses $H_{1/4}$ is taken as $H_{AVE1/4}$.

(Average Value $H_{AVE1/2}$ of Vickers Hardnesses $H_{1/2}$ at ½ Sheet-Thickness Position is 155 to 305)

When an average value $H_{AVE1/2}$ of Vickers hardnesses $H_{1/2}$ at a ½ sheet-thickness position is 155 or more, the steel sheet can provide a tensile strength of 540 MPa or more. When the average value $H_{AVE1/2}$ of the Vickers hardnesses $H_{1/2}$ at the ½ sheet-thickness position is 305 or less, the steel sheet is not excessively hardened at the ½ sheet-thickness position of the steel sheet, thus sufficiently exerting the effect of smoothing projections and depressions on surfaces of the steel sheet in rolling of the steel sheet.

A measuring method for the average value $H_{AVE1/2}$ of the Vickers hardnesses $H_{1/2}$ at the ½ sheet-thickness position is the same as the measuring method for the average value $H_{AVE1/4}$ of the Vickers hardnesses $H_{1/4}$ at the ¼ sheet-thickness positions except that they differ in measurement position in the sheet thickness direction.

(Width of Steel Sheet is 1000 mm or More)

A formed product of the steel sheet in the present embodiment is suitable for automobile panels. The automobile panels include panel components such as door outer panels. Examples of the panel components include a hood outer panel, a door outer panel, a roof panel, and a quarter panel such as a fender panel.

Strength enhancement of such automobile panels has also been underway as with automobile structure members. Hot rolled sheets that are steel sheets in a process of producing automobile panels have been made to have increased strengths. Further, as the automobile panels have been reduced in thickness, a rolling reduction in a cold rolling step in a process of producing steel sheets has been increased. Some automobile panel steel sheets, particularly steel sheets for door panels have widths that are more than 1000 mm, and some steel sheets for hood panels have widths that are more than 1500 mm. For such wide steel sheets, a rolling load (a load on a rolling mill) in a cold rolling step tends to increase. For example, in a case of a steel sheet having a tensile strength of 540 MPa-grade, the rolling load in cold rolling particularly increases when a width of the steel sheet is about 1500 mm or more. In a case of a steel sheet having a tensile strength of 780 MPa-grade, the rolling load in cold rolling particularly increases when a width of the steel sheet is about 1200 mm or more.

Unless such increases in rolling load in cold rolling are not coped with, a form accuracy of the steel sheets degenerate. Conventional methods for coping with such increases in rolling load in cold rolling include approaches such as annealing for softening performed before the cold rolling and a cold rolling step performed in two phases. The approaches reduce productivity, increasing production costs.

In contrast, the steel sheet in the present embodiment is a steel sheet that (i) has the chemical composition and the metal micro-structures according to the present embodiment, (ii) makes the value X1 obtained by dividing the standard deviation $\sigma_{1/4}$ of Vickers hardnesses $H_{1/4}$ at the ¼ sheet-thickness positions by the average value $H_{AVE1/4}$ of the Vickers hardnesses $H_{1/4}$ be 0.025 or less, and (iii) makes the value X2 obtained by dividing the standard deviation $\sigma_{1/2}$ of Vickers hardnesses $H_{1/2}$ at the ½ sheet-thickness position by the average value $H_{AVE1/2}$ of the Vickers hardnesses $H_{1/2}$ be 0.030 or less. Accordingly, for the wide panel as described above, (a) while a rolling load in cold rolling is reduced by making micro-structures of a hot rolled sheet softer, (b) reduction of ghost lines on a formed product can be achieved.

(Sheet Thickness of Steel Sheet is 0.20 to 1.00 mm)

The sheet thickness of the steel sheet according to the present embodiment is not limited to within a specific range. However, the sheet thickness is preferably 0.20 to 1.00 mm with consideration given to versatility and producibility. Setting the sheet thickness to 0.20 mm or more facilitates keeping a shape of a formed product flat, which enables improvement in dimensional accuracy and form accuracy. For this reason, the sheet thickness is preferably 0.20 mm or more, preferably 0.35 mm or more, and more preferably 0.40 mm or more.

In contrast, setting the sheet thickness to 1.00 mm or less enhances an effect of weight reduction of a member. For this reason, the sheet thickness is preferably 1.00 mm or less, preferably 0.70 mm or less, and more preferably 0.60 mm or less. The sheet thickness of the steel sheet can be measured with a micrometer.

(Tensile Strength of Steel Sheet is 540 to 980 MPa)

A tensile strength of the steel sheet according to the present embodiment is not limited to within a specific range. However, the tensile strength is preferably 540 to 980 MPa. When the tensile strength of the steel sheet is 540 MPa or more, a steel sheet that is thin-wall and high-strength can be provided. When the tensile strength of the steel sheet is 980 MPa or less, it is easy to keep formabilities for performing press forming on the steel sheet.

The tensile strength is measured by conducting a test in conformity to JIS (the Japanese Industrial Standards) Z2241: 2011, Metallic materials—Tensile testing—Method of test at room temperature, on a JIS No. 5 tensile test coupon extracted from the steel sheet in such a manner that a longitudinal direction of the JIS No. 5 tensile test coupon is a direction perpendicular to a rolling direction of the steel sheet.

The steel sheet according to the present embodiment may include a plating layer on at least one of its surfaces of the steel sheet. Examples of the plating layer include a galvanized layer and a galvanized alloy layer as well as a galvannealed layer and a galvannealed alloy layer, which are respectively a galvanized layer and a galvanized alloy layer subjected to alloying treatment.

The galvanized layer and the galvanized alloy layer are formed by a hot-dip galvanizing method, an electroplating method, or a vapor deposition plating method. When a content of Al in the galvanized layer is 0.5 mass % or less, the galvanized layer can have a sufficient adhesiveness between the surface of the steel sheet and the galvanized layer. It is therefore preferable that the content of Al in the galvanized layer be 0.5 mass % or less.

In a case where the galvanized layer is a hot-dip galvanized layer, a content of Fe in the hot-dip galvanized layer is preferably 3.0 mass % or less to increase the adhesiveness between the surface of the steel sheet and the galvanized layer.

In a case where the galvanized layer is an electrogalvanized layer, a content of Fe in the electrogalvanized layer is preferably 0.5 mass % or less from the point of improving corrosion resistance.

The galvanized layer and the galvanized alloy layer may contain one of, or two or more of Al, Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM within their respective range within which the elements do not hinder a corrosion resistance and formabilities of the steel sheet. In particular, Ni, Al, and Mg are effective in improving the corrosion resistance of the steel sheet.

The galvanized layer or the galvanized alloy layer may be respectively a galvannealed layer or a galvannealed alloy layer that is the galvanized layer or the galvanized alloy layer subjected to alloying treatment. When the alloying treatment is performed on a hot-dip galvanized layer or a hot-dip galvanized alloy layer, it is preferable to set a content of Fe in the hot-dip galvanized layer or the hot-dip galvanized alloy layer after the alloying treatment (a galvannealed layer or a galvannealed alloy layer) to 7.0 mass % to 13.0 mass % from the viewpoint of improving the adhesiveness between the surface of the steel sheet and the alloyed plating layer. By performing the alloying treatment on the steel sheet including the hot-dip galvanized layer or the hot-dip galvanized alloy layer, Fe is incorporated in the plating layer, thus increasing the content of Fe. The content of Fe can be thereby increased to 7.0 mass % or more. That is, a galvanized layer having a content of Fe of 7.0 mass % or more is a galvannealed layer or a galvannealed alloy layer.

The content of Fe in the plating layer can be obtained by the following method. Only the plating layer is dissolved and removed with a 5 vol % aqueous solution of HCl with an inhibitor added thereto. A content of Fe in the resultant solution is measured by the inductively coupled plasma-atomic emission spectrometry (ICP-AES), and the content of Fe (mass %) in the plating layer is obtained.

(Steel Sheet to be Used as Automobile Skin Panel)

Next, a press-formed product produced by performing the press forming on the steel sheet described above will be described. The press-formed product has the same chemical composition as the steel sheet. Further, the press-formed product may include the plating layer described above on at least one of surfaces of the steel sheet. Since the press-formed product is obtained by performing the press forming on the steel sheet, development of ghost lines is prevented, and thus the press-formed product is excellent in appearance quality. As a result, it is possible to provide an automobile with a high marketability thanks to its excellent appearance that directly comes to consumer's notice. Concrete examples of the press-formed product include panel components such as a door outer panel of an automobile body (automobile skin panel) as described above. Examples of the panel components include a hood outer panel, a door outer panel, a roof panel, and a quarter panel such as a fender panel.

<Production Method>

Next, a preferable method for producing the steel sheet according to the present embodiment will be described. Irrespective of its production method, the steel sheet according to the present embodiment having the properties described above provides its effects. However, the following method is preferable because it enables the steel sheet to be produced stably Specifically, the steel sheet according to the present embodiment can be produced by a production method including the following steps (i) to (iv):

(i) a slab forming step of solidifying a molten steel having the chemical composition described above to form a slab, (ii) a hot rolling step of heating the slab, subjecting the slab to hot rolling to provide a hot-rolled steel sheet in such a manner that a rolling finish temperature is 950° C. or less, and then coiling the hot-rolled steel sheet at 450 to 650° C., (iii) a cold rolling step of uncoiling the coiled hot-rolled steel sheet and subjecting the hot-rolled steel sheet to cold rolling in which an accumulative rolling ratio, an RCR, is 50 to 90%, to provide a cold-rolled steel sheet, and (iv) a step of annealing the cold-rolled steel sheet and then forming the plating layer described above as necessary.

The steps will be described below.

[Slab Forming Step]

In the slab forming step, a molten steel having a predetermined chemical composition is formed into a slab. Any manufacturing method may be used for the slab forming step. For example, a molten steel having the chemical composition is melted with a converter, an electric furnace, or the like, and subjected to a continuous casting process. A slab thereby produced may be used. In place of the continuous casting process, an ingot-making process, a thin slab casting process, or the like may be adopted.

[Hot Rolling Step]

The slab is heated to 1100° C. or more before the hot rolling. When the heating temperature is set to 1100° C. or more, a rolling reaction force is not to be increased excessively in the subsequent hot rolling, helping to yield a product thickness as intended. In addition, setting the heating temperature to 1100° C. or more enables an increase in a precision of a sheet shape, thus enabling a smooth coiling.

There is no need to limit an upper limit of the heating temperature of the cast piece. However, the heating temperature is preferably set to less than 1300° C. from the economical viewpoint.

In the hot rolling step, the cast piece heated to the heating temperature is subjected to the hot rolling. In the hot rolling, finish rolling is performed after rough rolling. In the finish rolling, rolling is performed a plurality of times.

The finish rolling is performed with a plurality of roll stands arranged consecutively. A rolling reduction of the roll stands in the second half is set to be higher than a rolling reduction of the roll stands in the first half. The rolling reduction of the finish rolling in the first half is set to less than 35%, and the rolling reduction of the finish rolling in the second half is set to 35% or more. This enables the rolling reduction of the finish rolling in the second half to be set high. As a result, a hot rolled sheet, which is a sheet subjected to the hot rolling, can be softened moderately. Therefore, a load on a rolling mill can be reduced in the cold rolling step. Further, hard phases such as pearlite and martensite can be prevented from being produced in banded shapes in a micro-structure of the hot rolled sheet, and hard phases such as martensite can be prevented from being produced in banded shapes also in a micro-structure of a formed product being a finished product.

A ratio between a rolling reduction P2 of the roll stands in the second half and a rolling reduction P1 of the roll stands in the first half, P2/P1, is preferably more than 1.0 to 1.6 or less. By setting P2/P1 to more than 1.0, the hot rolled sheet can be softened sufficiently, and the hard phases can be prevented from being produced in banded shapes in the micro-structure of the formed product being a finished product. By setting P2/P1 to 1.6 or less, loads on the roll stands in the second half can be mitigated.

A rolling reduction of a final roll stand is preferably set to 40% or more. This makes it easier to prevent the hard phases such as pearlite and martensite from being produced in banded shapes in the micro-structure of the hot rolled sheet and makes it easier to prevent the hard phases such as martensite from being produced in banded shapes also in the micro-structure of the formed product being a finished product.

For the finish rolling, for example, seven roll stands are provided consecutively. In the present embodiment, first to third stands are first half stands, and fifth to seventh stands are second half stands. The number of the roll stands may be any number as long as a rolling reduction of roll stands in the second half out of a plurality of roll stands is set to be higher than a rolling reduction of roll stands in the first half out of the plurality of roll stands.

The rolling finish temperature is set to 950° C. or less. By setting the rolling finish temperature to 950° C. or less, an average grain diameter of the hot-rolled steel sheet does not increase excessively. In this case, an average grain diameter of a final product sheet also can be decreased, which enables the final product sheet to keep a sufficient yield strength and to keep a high surface quality after forming.

A coiling temperature in the hot rolling step is preferably set to 450 to 650° C. By setting the coiling temperature to 650° C. or less, grain diameters can be made small, which enables the steel sheet to keep a sufficient strength. Further, thicknesses of scales can be reduced, which enables the steel sheet to have sufficient pickling properties. In addition, by setting the coiling temperature to 450° C. or more, a strength of the hot-rolled steel sheet does not increase excessively, which reduces a load to a facility for performing the cold rolling step, thus further increasing productivity.

[Cold Rolling Step]

In the cold rolling step, a cold-rolled steel sheet is provided by performing the cold rolling in which an accumulative rolling ratio, an RCR, is 50 to 90%. By performing the cold rolling with the accumulative rolling ratio on the hot-rolled steel sheet given a predetermined residual stress, ferrite including desired texture is provided after annealing and cooling.

When the accumulative rolling ratio RCR is 50% or more, a sheet thickness of the cast piece that is calculated backward from the sheet thickness of the steel sheet can be kept sufficiently in the hot rolling step, and thus it is practical to perform the hot rolling step. In addition, when the accumulative rolling ratio RCR is 90% or less, a rolling load does not increase excessively, and a uniformity of a material quality of the steel sheet in a sheet width direction can be kept sufficiently. Further, a stability of the production can be kept sufficiently. For this reason, the accumulative rolling ratio RCR in the cold rolling is set to 50 to 90%.

[Annealing Step]

In the annealing step, annealing in which the cold-rolled steel sheet is heated to and held at a holding temperature of 750 to 900° C. is performed. When the holding temperature is 750° C. or more, recrystallization of ferrite and the reverse transformation from ferrite to austenite proceed sufficiently, and thus a desired texture can be provided. In contrast, when the holding temperature is 900° C. or less, grains are densified, and thus a sufficient strength is provided. Further, the heating temperature is not excessively high, and thus productivity can be increased.

[Cooling Step]

In the cooling step, the cold-rolled steel sheet that has been held in the annealing step is cooled. The cooling is performed in such a manner that an average cooling rate of the cooling from the holding temperature is 5.0 to 50° C./sec. When the average cooling rate is 5.0° C./sec or more, ferrite transformation is not promoted excessively, which increases a production number of hard phases such as martensite, providing a desired strength. In addition, when the average cooling rate is 50° C./sec or less, the steel sheet can be cooled more uniformly in the width direction of the steel sheet.

[Plating Step]

The cold-rolled steel sheet provided by the method may be further subjected to a plating step of forming plating layers on the surfaces of the cold-rolled steel sheet.

[Alloying Step]

The plating layers formed in the plating step may be alloyed. In an alloying step, an alloying temperature is, for example, 450 to 600° C.

In the production method described above, the steel sheet can be made to include less connected hard phases by applying heavy reduction in second half stand, in which a rolling reduction is increased in the second half of finish rolling in the hot rolling step. This makes a formed product after forming have a small anisotropy in projection-depression shape on its surface and thus can prevent the development of ghost lines, providing an excellent appearance quality. Moreover, from an aspect of producibility of the steel sheet, the hot rolled sheet can be softened moderately, and cold-rolling workability can also be increased without the necessity of annealing for softening or performing cold rolling twice.

In the present embodiment, the steel sheet after hot-rolling working is not subjected to shape straightening with a leveler as a shape straightening apparatus. The steel sheet in the present embodiment is required to have high surface texture to provide high appearance quality. For this reason, a steel sheet that needs shape straightening with a leveler cannot be used in the present embodiment. In other words, the steel sheet in the present embodiment is not supposed to be produced by a manufacturing method that includes a special hot rolling step in which a leveler is disposed on an outlet side of a stand for finish rolling. Therefore, the method for producing the steel sheet in the present embodiment does not involve the use of a leveler in combination.

EXAMPLE

Next, Examples of the present invention will be described. Note that conditions described in Examples are merely an example of conditions that was adopted for confirming feasibility and effects of the present invention, and the present invention is not limited to this example of conditions. In the present invention, various conditions can be adopted as long as the conditions allow the objective of the present invention to be achieved without departing from the gist of the present invention.

Steels having chemical compositions shown as Cast piece Nos. A to K shown in Table 1 were melted and subjected to continuous casting to be produced into slabs each having a thickness of 200 to 300 mm. Some of the resultant slabs were subjected to hot rolling under conditions shown in Table 2 and coiled. For finish rolling in the hot rolling, seven roll stands were provided consecutively. First three stands (first to third stands) were used as first half stands, and last three stands (fifth to seventh stands) were used as second half stands.

Then, the coil was uncoiled, and specimens were cut from the resultant hot rolled sheet and subjected to measurement of tensile strength. The tensile strength was evaluated in conformance with JIS Z 2241: 2011. The specimens were cut in the form of No. 5 test coupons specified in JIS Z 2241: 2011. An extract position of a tensile test specimen was a ¼ portion from an edge portion of the hot rolled sheet in its sheet width direction, and a longitudinal direction of the tensile test specimen was set to be a direction perpendicular to its rolling direction.

After pickling, cold rolling was performed at accumulative rolling ratios RCR shown in Table 2, by which steel sheets A1 to K1 were provided.

Thereafter, annealing and cooling were performed under conditions including holding temperatures and cooling rates after heating (average cooling rates) shown in Table 3. In addition, some of the steel sheets were subjected to various types of plating to have plating layers formed on their surfaces and were subjected to alloying treatment at alloying temperatures shown in Table 3. In Table 4, CR indicates being unplated, GI indicates galvanizing, GA indicates galvannealing, and EG indicates electrogalvanizing.

The resultant product sheets of Nos. A1a to K1a (i.e., product sheets of Nos. A1a to A2a, B1a to B2a, C1a to C2a, D1a to D5a, E1a, F1a, G1a, H1a, I1a, J1a, and K1a) were subjected measurements of their sheet widths and their sheet thicknesses.

Further, the product sheets of Nos. A1a to K1a were subjected to measurement of their tensile strengths. The tensile strength was evaluated in conformance with JIS Z 2241: 2011. The specimens were cut in the form of No. 5 test coupons specified in JIS Z 2241: 2011. An extract position of a tensile test specimen was a ¼ portion from an edge portion of the product sheet in its sheet width direction, and a longitudinal direction of the tensile test specimen was set to be a direction perpendicular to its rolling direction. When the resultant tensile test specimen gave a tensile strength of 540 MPa or more, the tensile test specimen was determined to have a high strength and rated as good. When the resultant tensile test specimen gave a tensile strength of less than 540 MPa, the tensile test specimen was determined to be poor in strength and rated as failed.

Volume fractions of the ferrite and the hard phases in metal micro-structures of the resultant product sheets of Nos. A1a to K1a were measured by the method described above. In each of the metal micro-structures of the product sheets of Nos. A1a to K1a, a total of the volume fractions of the hard phases and the ferrite was 100%.

Average grain diameters of the ferrite and average grain diameters of the hard phases in the metal micro-structures of the resultant product sheets of Nos. A1a to K1a were measured by the method described above.

Results are shown in Table 4.

TABLE 1

| Cast piece No. | Chemical Composition (mass %) | | | | | | | | | | | | | | | |
|---|---|---|---|---|---|---|---|---|---|---|---|---|---|---|---|---|
| | C | Si | Mn | P | S | Al | N | B | Mo | Ti | Nb | V | Cr | Ni | O | Other elements |
| A | 0.077 | 0.450 | 2.24 | 0.016 | 0.003 | 0.042 | 0.0035 | | | | | | 0.41 | | 0.0011 | |
| B | 0.083 | 0.430 | 2.19 | 0.015 | 0.001 | 0.038 | 0.0028 | | | 0.020 | | | | 0.08 | 0.0013 | |
| C | 0.090 | 0.410 | 1.95 | 0.013 | 0.002 | 0.042 | 0.0036 | | | | | | | | 0.0014 | |
| D | 0.063 | 0.039 | 1.78 | 0.031 | 0.001 | 0.350 | 0.0027 | 0.0015 | 0.08 | | 0.01 | 0.02 | 0.38 | | 0.0009 | |
| E | 0.181 | 0.150 | 1.86 | 0.017 | 0.004 | 0.062 | 0.0048 | | 0.09 | | | | 0.15 | | 0.0010 | |
| F | 0.026 | 0.230 | 1.81 | 0.017 | 0.004 | 0.062 | 0.0048 | | | 0.020 | | | 0.32 | | 0.0012 | |
| G | 0.084 | 0.030 | 2.85 | 0.015 | 0.002 | 0.112 | 0.0038 | | | | 0.02 | | | | 0.0011 | |
| H | 0.075 | 0.436 | 2.19 | 0.011 | 0.002 | 0.039 | 0.0040 | | | | | | 0.40 | | 0.0008 | Cu: 0.04, W: 0.06 |
| I | 0.078 | 0.446 | 2.22 | 0.021 | 0.002 | 0.029 | 0.0038 | | | | | | 0.39 | | 0.0016 | Sn: 0.05, Sb: 0.09 |
| J | 0.065 | 0.045 | 1.71 | 0.014 | 0.003 | 0.291 | 0.0041 | 0.0014 | 0.08 | 0.015 | | | 0.42 | | 0.0012 | Ca: 0.0019, REM: 0.0015 |
| K | 0.063 | 0.039 | 1.69 | 0.016 | 0.002 | 0.304 | 0.0039 | 0.0016 | 0.08 | 0.013 | | | 0.42 | | 0.0014 | Mg: 0.0028, Zr: 0.0055 |

The underline indicates that the underlined value fell out of its range according to the present invention.

TABLE 2

| Cast piece No. | Steel sheet No. | Hot rolling | | | | | | | Hot rolled sheet tensile strength (MPa) | Cold rolling Rolling reduction RCR (%) |
|---|---|---|---|---|---|---|---|---|---|---|
| | | Heating temperature (° C.) | First half average rolling reduction P1 (%) | Second half average rolling reduction P2 (%) | Second half rolling reduction P2/First half rolling reduction P1 | Final stand rolling reduction (%) | Rolling finish temperature (° C.) | Coiling temperature (° C.) | | |
| A | A1 | 1200 | 30 | 40 | 1.33 | 42 | 900 | 520 | 710 | 83 |
| A | A2 | 1200 | 39 | 28 | 0.72 | 28 | 900 | 550 | 790 | 83 |
| B | B1 | 1230 | 29 | 45 | 1.55 | 45 | 880 | 530 | 722 | 80 |
| B | B2 | 1230 | 38 | 25 | 0.66 | 28 | 880 | 530 | 785 | 80 |
| C | C1 | 1200 | 32 | 38 | 1.19 | 40 | 920 | 620 | 526 | 83 |
| C | C2 | 1200 | 40 | 25 | 0.63 | 22 | 920 | 620 | 545 | 83 |
| D | D1 | 1250 | 28 | 40 | 1.43 | 44 | 900 | 540 | 563 | 78 |
| D | D2 | 1250 | 39 | 27 | 0.69 | 25 | 900 | 540 | 592 | 78 |
| D | D3 | 1250 | 28 | 42 | 1.50 | 42 | 910 | 570 | 570 | 85 |
| D | D4 | 1250 | 29 | 40 | 1.38 | 40 | 910 | 570 | 560 | 72 |
| D | D5 | 1250 | 28 | 32 | 1.14 | 34 | 910 | 570 | 584 | 83 |
| E | E1 | 1180 | 34 | 36 | 1.06 | 40 | 910 | 580 | 615 | 83 |
| F | F1 | 1230 | 30 | 45 | 1.50 | 46 | 900 | 550 | 485 | 85 |
| G | G1 | 1250 | 33 | 36 | 1.09 | 40 | 890 | 600 | 835 | 78 |
| H | H1 | 1220 | 30 | 40 | 1.33 | 42 | 890 | 540 | 725 | 80 |

TABLE 2-continued

| Cast piece No. | Steel sheet No. | Hot rolling: Heating temperature (° C.) | First half average rolling reduction P1 (%) | Second half average rolling reduction P2 (%) | Second half rolling reduction P2/First half rolling reduction P1 | Final stand rolling reduction (%) | Rolling finish temperature (° C.) | Coiling temperature (° C.) | Hot rolled sheet tensile strength (MPa) | Cold rolling Rolling reduction RCR (%) |
|---|---|---|---|---|---|---|---|---|---|---|
| I | I1 | 1220 | 28 | 40 | 1.43 | 40 | 890 | 590 | 720 | 83 |
| J | J1 | 1230 | 28 | 42 | 1.50 | 44 | 900 | 550 | 570 | 78 |
| K | K1 | 1230 | 30 | 40 | 1.33 | 42 | 900 | 550 | 574 | 80 |

The underline indicates that the underlined value fell out of its preferable range according to the present invention.

TABLE 3

| Cast piece No. | Steel sheet No. | Annealing Holding temperature (° C.) | Cooling Cooling rate after heating (° C./sec) | Alloying Alloying temperature (° C.) |
|---|---|---|---|---|
| A | A1 | 840 | 8 | 550 |
| A | A2 | 840 | 8 | 550 |
| B | B1 | 820 | 6 | 570 |
| B | B2 | 820 | 6 | 570 |
| C | C1 | 790 | 10 | — |
| C | C2 | 790 | 10 | — |
| D | D1 | 820 | 10 | 540 |
| D | D2 | 820 | 10 | 540 |
| D | D3 | 790 | 9 | 580 |
| D | D4 | 790 | 10 | 560 |
| D | D5 | 790 | 9 | 560 |
| E | E1 | 800 | 8 | — |
| F | F1 | 810 | 7 | 500 |
| G | G1 | 850 | 8 | 560 |
| H | H1 | 810 | 8 | — |
| I | I1 | 800 | 8 | — |
| J | J1 | 780 | 10 | 550 |
| K | K1 | 800 | 8 | 560 |

TABLE 4

| Steel sheet No. | Product sheet No. | Sheet width (mm) | Sheet thickness (mm) | Plating type | Tensile strength (MPa) | Ferrite volume fraction (%) | Hard phase volume fraction (%) | Ferrite average grain diameter (μm) | Hard phase average grain diameter (μm) | Remarks |
|---|---|---|---|---|---|---|---|---|---|---|
| A1 | A1a | 1400 | 0.40 | GA | 831 | 75 | 25 | 8.6 | 1.8 | Example |
| A2 | A2a | 1400 | 0.40 | GA | 844 | 76 | 24 | 9.2 | 2.1 | Comp. ex. |
| B1 | B1a | 1420 | 0.45 | GA | 816 | 78 | 22 | 8.1 | 1.7 | Example |
| B2 | B2a | 1420 | 0.45 | GA | 825 | 78 | 22 | 7.8 | 1.8 | Comp. ex. |
| C1 | C1a | 1500 | 0.40 | CR | 640 | 87 | 13 | 13.4 | 3.8 | Example |
| C2 | C2a | 1500 | 0.40 | CR | 645 | 88 | 12 | 13.5 | 3.7 | Comp. ex. |
| D1 | D1a | 1480 | 0.50 | GA | 615 | 90 | 10 | 11.2 | 3.4 | Example |
| D2 | D2a | 1480 | 0.50 | GA | 620 | 89 | 11 | 10.9 | 3.6 | Comp. ex. |
| D3 | D3a | 1450 | 0.35 | GA | 605 | 88 | 12 | 10.5 | 3.5 | Example |
| D4 | D4a | 1550 | 0.70 | GA | 609 | 87 | 13 | 10.8 | 3.8 | Example |
| D5 | D5a | 1500 | 0.40 | GA | 610 | 88 | 12 | 11.2 | 4.0 | Comp. ex. |
| E1 | E1a | 1400 | 0.40 | CR | 715 | 81 | 19 | 14.3 | 3.6 | Comp. ex. |
| F1 | F1a | 1520 | 0.40 | GA | 528 | 96 | 4 | 15.6 | 4.1 | Comp. ex. |
| G1 | G1a | 1380 | 0.50 | GA | 878 | 69 | 31 | 10.1 | 2.5 | Comp. ex. |
| H1 | H1a | 1400 | 0.45 | GI | 807 | 76 | 24 | 8.6 | 2.0 | Example |
| I1 | I1a | 1280 | 0.40 | EG | 820 | 75 | 25 | 9.0 | 2.1 | Example |
| J1 | J1a | 1500 | 0.55 | GA | 629 | 87 | 13 | 10.5 | 3.2 | Example |
| K1 | K1a | 1460 | 0.45 | GA | 638 | 86 | 14 | 10.4 | 3.4 | Example |

The underline indicates that the underlined value fell out of its range according to the present invention or its preferable range.

For each of the resultant product sheets of Nos. A1a to K1a, at a ¼ sheet-thickness position from a front surface of the product sheet. Vickers hardnesses $H_{1/4}$ were measured at 50 points in the rolling direction at measurement intervals of 150 μm by the method described above. At a ¼ sheet-thickness position from a back surface of the product sheet, Vickers hardnesses $H_{1/4}$ were measured at 50 points in the rolling direction at measurement intervals of 150 μm by the method described above. A value X1, which is obtained by dividing a standard deviation $\sigma_{1/4}$ of the Vickers hardnesses $H_{1/4}$ at the 100 points by an average value $H_{AVE1/4}$ of the Vickers hardnesses $H_{1/4}$ at the 100 points, was calculated.

For each of the resultant product sheets of Nos. A1a to K1a, at a ½ sheet-thickness position from a front surface of the product sheet, Vickers hardnesses $H_{1/2}$ were measured at 50 points in the rolling direction at measurement intervals of 150 μm by the method described above. A value X2, which is obtained by dividing a standard deviation $\sigma_{1/2}$ of the Vickers hardnesses $H_{1/2}$ at the 50 points by an average value $H_{AVE1/2}$ of the Vickers hardnesses $H_{1/2}$ at the 50 points, was calculated.

For each of the resultant product sheets of Nos. A1a to K1a, an area fraction of hard phases connected together to extend 100 μm or more in the rolling direction was measured in a region between the ¼ sheet-thickness position and the ½ sheet-thickness position by the method described above.

For each of the product sheets of Nos. A1a to K1a, its tensile test specimen with a surface brought into a mirror surface condition by polishing paper or the like was given 5% distortion by a tensile test, and an aspect ratio Str of surface texture of the tensile test specimen was measured by the method described above.

For each of the product sheets of Nos. A1a to K1a, its tensile test specimen with a surface brought into a mirror surface condition by polishing paper or the like was given 5% distortion by a tensile test, and a surface roughness Wa (arithmetic mean waviness) of the tensile test specimen was measured by the following method. A laser displacement measurement apparatus (VK-X1000 manufactured by KEYENCE) was used to measure 50 lines of profiles along a direction perpendicular to the rolling direction. At that time, wavelength components of 0.8 mm or less and 2.5 mm or more were removed. From a result obtained, arithmetic mean wavinesses was calculated in conformance with JIS B 0601: 2013, and an average value of the arithmetic mean wavinesses for 50 lines in total was calculated. The surface roughness Wa of the product sheet was thereby provided.

A product of the tensile strength of each of the product sheets of Nos. A1a to K1a and the aspect ratio Str of surface texture of the tensile-tested specimen of the product sheet was calculated. Tensile strength TS×aspect ratio Str is an index indicating that, when the index is high, an anisotropy in projection-depression shape on a surface of a product sheet is small although the product sheet is high in strength and thus low in workability.

Results are shown in Table 5.

small although its strength was high, thus being low in workability. An average value of (tensile strength of product sheet−tensile strength of hot rolled sheet) for the 10 examples was 77 whereas an average value of (tensile strength of product sheet−tensile strength of hot rolled sheet) for 8 comparative examples was about 54. That is, in the examples, sufficient differences were made between tensile strengths of their product sheets and tensile strengths of their hot rolled sheet, and thus softening of their hot rolled sheets was achieved. In particular, examples prove that a load on a rolling mill in the cold rolling step is reduced for wide product sheets suitable for automobile hood panels and automobile door panels.

In contrast, in product sheets of Nos. A2a and B2a, which were comparative examples, their small rolling reductions in the second half of the finish rolling in the hot rolling resulted in a failure to sufficiently smooth streaky projections and depressions on surfaces of their steel sheets, their area fractions of hard phases connected together to extend 100 μm or more in the rolling direction were more than 40% in the region between a ¼ sheet-thickness position and a ½ sheet-thickness position, in addition, aspect ratios Str of surface texture of their tensile-tested specimens fell below 0.28, and further, their tensile strength TS×aspect ratio Str

TABLE 5

| | | ¼ sheet-thickness position | | | ½ sheet-thickness position | | | | | | | |
|---|---|---|---|---|---|---|---|---|---|---|---|---|
| Steel sheet No. | Product sheet No. | $H_{1/4}$ = Overall average Vickers hardness | $\sigma_{1/4}$ = Standard deviation | X1 = Standard deviation/Average | $H_{1/2}$ = Overall average Vickers hardness | $\sigma_{1/2}$ = Standard deviation | X2 = Standard deviation/Average | Area fraction of hard phases connected to extend 100 μm or more (%) | Wa (μm) | Surface texture aspect ratio Str | Tensile strength × Str | Remarks |
| A1 | A1a | 228 | 4.49 | 0.020 | 230 | 5.27 | 0.023 | 25 | 0.058 | 0.30 | 246.0 | Example |
| A2 | A2a | 234 | 7.17 | 0.031 | 238 | 8.75 | 0.037 | 43 | 0.050 | 0.21 | 179.8 | Comp. ex. |
| B1 | B1a | 226 | 5.14 | 0.023 | 231 | 5.50 | 0.024 | 28 | 0.055 | 0.29 | 234.2 | Example |
| B2 | B2a | 230 | 6.58 | 0.029 | 233 | 7.11 | 0.031 | 41 | 0.053 | 0.20 | 168.3 | Comp. ex. |
| C1 | C1a | 184 | 4.25 | 0.023 | 186 | 5.10 | 0.027 | 22 | 0.058 | 0.33 | 211.2 | Example |
| C2 | C2a | 185 | 4.78 | 0.026 | 188 | 5.84 | 0.031 | 33 | 0.056 | 0.26 | 167.7 | Comp. ex. |
| D1 | D1a | 180 | 4.18 | 0.023 | 182 | 5.31 | 0.029 | 19 | 0.055 | 0.35 | 216.5 | Example |
| D2 | D2a | 179 | 4.59 | 0.026 | 182 | 5.62 | 0.031 | 32 | 0.055 | 0.27 | 166.8 | Comp. ex. |
| D3 | D3a | 181 | 4.06 | 0.022 | 183 | 4.59 | 0.025 | 15 | 0.054 | 0.34 | 205.7 | Example |
| D4 | D4a | 183 | 4.02 | 0.022 | 185 | 4.65 | 0.025 | 18 | 0.053 | 0.35 | 213.2 | Example |
| D5 | D5a | 183 | 4.59 | 0.025 | 185 | 5.69 | 0.031 | 35 | 0.056 | 0.27 | 164.7 | Comp. ex. |
| E1 | E1a | 209 | 5.84 | 0.028 | 214 | 6.65 | 0.031 | 33 | 0.068 | 0.24 | 172.3 | Comp. ex. |
| F1 | F1a | 156 | 3.14 | 0.020 | 157 | 3.85 | 0.025 | 10 | 0.049 | 0.36 | 190.1 | Comp. ex. |
| G1 | G1a | 242 | 7.25 | 0.030 | 246 | 7.93 | 0.032 | 45 | 0.071 | 0.19 | 166.8 | Comp. ex. |
| H1 | H1a | 230 | 4.47 | 0.019 | 234 | 5.15 | 0.022 | 22 | 0.058 | 0.31 | 250.2 | Example |
| I1 | I1a | 232 | 4.58 | 0.020 | 237 | 5.39 | 0.023 | 24 | 0.054 | 0.30 | 246.0 | Example |
| J1 | J1a | 186 | 4.24 | 0.023 | 189 | 4.95 | 0.026 | 20 | 0.050 | 0.35 | 220.2 | Example |
| K1 | K1a | 188 | 4.31 | 0.023 | 190 | 4.78 | 0.025 | 15 | 0.054 | 0.36 | 229.7 | Example |

The underline indicates that the underlined value fell out of its range according to the present invention or its preferable range.

As shown in Table 1 to Table 5, there is a tendency for aspect ratios Str of surface texture of tensile-tested specimens in examples to be clearly higher than aspect ratios Str of surface texture of tensile-tested specimens in comparative examples, and thus the examples resulted in small anisotropies in projection-depression shape on their surfaces and were excellent in strength and surface quality. In more detail, in every example, its tensile strength was more than 540 MPa, showing a high strength. In each example, the aspect ratio Str of surface texture of its tensile-tested specimen was 0.28 or more, its area of connected hard phases extending 100 μm or more was 30% or less of its area of all hard phases, and ghost lines were sufficiently reduced. Moreover, in every example, tensile strength TS×aspect ratio Str was as sufficiently high as more than 200, thus indicating that an anisotropy in projection-depression shape on its surface was fell below 180. Therefore, their surface qualities after forming were low. In product sheets of Nos. C2a and D2a, which were comparative examples, their small rolling reductions in the second half of the finish rolling in the hot rolling resulted in a failure to sufficiently smooth streaky projections and depressions on surfaces of their steel sheets, their area fractions of hard phases connected together to extend 100 μm or more in the rolling direction were more than 30% in the region between a ¼ sheet-thickness position and a ½ sheet-thickness position, in addition, aspect ratios Str of surface texture of their tensile-tested specimens fell below 0.28, and further, their tensile strength TS×aspect ratio Str fell below 170. Therefore, their surface qualities after forming were low. In a product sheet of No. D5a, which was a comparative example, although its ratio P2/P1 between the rolling reduction P2 in the second half and the rolling reduction P1 in the first half of the finish rolling in the hot rolling was within the range of more than 1.0 to 1.6 or less, its small rolling reduction in the second half of the finish rolling resulted in a failure to sufficiently smooth streaky projections and depressions on a surface of its steel sheet, its area fraction of hard phases connected together to extend 100 μm or more in the rolling direction was more than 30% in the region between a ¼ sheet-thickness position and a ½ sheet-thickness position, in addition, an aspect ratio Str of surface texture of its tensile-tested specimen fell below 0.28, and further, its tensile strength TS×aspect ratio Str fell below 170. Therefore, its surface quality after forming was low.

In a product sheet of No. E1a, which was a comparative example, its content of carbon exceeded the preferable range, making banded Mn segregation likely to occur. As a result, its area fraction of hard phases connected together to extend 100 μm or more in the rolling direction was more than 30% in the region between a ¼ sheet-thickness position and a ½ sheet-thickness position, and in addition, its tensile strength TS×aspect ratio Str fell below 180. Therefore, its surface quality after forming was low. In a product sheet of No. F1a, which was a comparative example, its content of carbon did not reach the preferable range, its volume fraction of ferrite was excessively large, and its volume fraction of hard phases was small. Therefore, its product sheet resulted in such a low tensile strength as not to reach 540 MPa. In a product sheet of No. G1a, which was a comparative example, its content of Mn exceeded the preferable range, causing banded Mn segregation to occur in solidification of its steel. As a result, its area fraction of hard phases connected together to extend 100 μm or more in the rolling direction was more than 40% in the region between a ¼ sheet-thickness position and a ½ sheet-thickness position, and in addition, its tensile strength TS×aspect ratio Str fell below 170. Therefore, its surface quality after forming was low.

Here, a comparison between the product sheets of Nos. A1a and A2a having the same sheet thickness, a comparison between the product sheets of Nos. B1a and B2a having the same sheet thickness, a comparison between the product sheets of Nos. C1a and C2a having the same sheet thickness, and a comparison between the product sheets of Nos. D1a and D2a having the same sheet thickness are made. The product sheets of Nos. A1a, B1a, C1a, and D1a, which were examples, had surface roughnesses Wa of 0.058 μm, 0.055 μm, 0.058 μm, and 0.055 μm, respectively. In contrast, the product sheet of Nos. A2a, B2a, C2a, and D2a, which were comparative examples, had surface roughnesses Wa of 0.050 μm, 0.053 μm, 0.056 μm, and 0.055 μm, respectively. Thus, the surface roughness Wa of the product sheet of No. Ala being an example was not less than the surface roughness Wa of the product sheet of No. A2a being a comparative example, and the surface roughnesses Wa of the product sheets of Nos. B1a, C1a, and D1a being examples were not less than the surface roughness Wa of the product sheets of Nos. B2a, C2a, and D2a being comparative examples, respectively. At the same time, the aspect ratios Str of the product sheets of Nos. A1a, B1a, C1a, and D1a being examples were higher than the aspect ratios Str of the product sheets of Nos. A2a, B2a, C2a, and D2a being comparative examples, respectively. As seen from the above, although the surface roughnesses Wa of the product sheets of Nos. A1a, B1a, C1a, and D1a being examples were not less than the surface roughnesses Wa of the product sheets of Nos. A2a, B2a, C2a, and D2a being comparative examples, respectively, the product sheets of Nos. A1a, B1a, C1a, and D1a were higher than the product sheets of Nos. A2a, B2a, C2a, and D2a in aspect ratio Str. This proves that the product sheets of Nos. A1a, B1a, C1a, and D1a had small anisotropies in projections and depressions on their surfaces, thus being excellent in surface quality.

INDUSTRIAL APPLICABILITY

According to the aspects of the present invention, a steel sheet that delivers an excellent appearance quality in its formed product can be provided.

The invention claimed is:

1. A steel sheet comprising a chemical composition comprising, in mass %:

C: 0.030% to 0.145%,
Si: 0% to 0.500%,
Mn: 0.50% to 2.50%,
P: 0% to 0.100%,
S: 0% to 0.020%,
Al: 0% to 1.000%,
N: 0% to 0.0100%,
B: 0% to 0.0050%,
Mo: 0% to 0.80%,
Ti: 0% to 0.200%,
Nb: 0% to 0.10%,
V: 0% to 0.20%,
Cr: 0% to 0.80%,
Ni: 0% to 0.25%,
O: 0% to 0.0100%,
Cu: 0% to 1.00%,
W: 0% to 1.00%,
Sn: 0% to 1.00%,
Sb: 0% to 0.20%,
Ca: 0% to 0.0100%,
Mg: 0% to 0.0100%,
Zr: 0% to 0.0100%, and
REM: 0% to 0.0100%, with the balance being Fe and impurities, wherein a metal micro-structure consists of 70 to 95% ferrite in volume fraction and 5 to 30% hard phases in volume fraction, a value X1 obtained by dividing a standard deviation of Vickers hardnesses $H_{1/4}$ at ¼ sheet-thickness positions by an average value of the Vickers hardnesses $H_{1/4}$ is 0.025 or less, and a value X2 obtained by dividing a standard deviation of Vickers hardnesses $H_{1/2}$ at a ½ sheet-thickness position by an average Value of the Vickers hardnesses $H_{1/2}$ is 0.030 or less.

2. The steel sheet according to claim 1, wherein an average grain diameter of the ferrite is 5.0 μm to 30.0 μm, and an average grain diameter of the hard phases is 1.0 μm to 5.0 μm.

3. The steel sheet according to claim 1, wherein an area of hard phases connected together to extend 100 μm or more in a rolling direction of the steel sheet is 30% or less of an area of all hard phases in a region between a ¼ sheet-thickness position and a ½ sheet-thickness position.

4. The steel sheet according to claim 1, wherein an aspect ratio Str (ISO 25178) of surface texture of a specimen of the steel sheet given 5% distortion in a tensile test is 0.28 or more.

5. The steel sheet according to claim 1, wherein an average value of Vickers hardnesses $H_{1/4}$ at ¼ sheet-thickness positions is 150 to 300, and an average value of Vickers Hardnesses $H_{1/2}$ at a ½ sheet-thickness position is 155 to 305.

6. The steel sheet according to claim 1, wherein the hard phases comprise one or more of martensite, bainite, tempered martensite, and pearlite.

7. The steel sheet according to claim 1, wherein a sheet thickness of the steel sheet is 0.20 mm to 1.00 mm.

8. The steel sheet according to claim 1, wherein the steel sheet is an automobile skin panel.

9. A steel sheet comprising a chemical composition comprising, in mass %:

C: 0.030% to 0.145%,
Si: 0% to 0.500%,
Mn: 0.50% to 2.50%,
P: 0% to 0.100%,
S: 0% to 0.020%,
Al: 0% to 1.000%,
N: 0% to 0.0100%,
B: 0% to 0.0050%,
Mo: 0% to 0.80%,
Ti: 0% to 0.200%,
Nb: 0% to 0.10%,
V: 0% to 0.20%,
Cr: 0% to 0.80%,
Ni: 0% to 0.25%,
O: 0% to 0.0100%,
Cu: 0% to 1.00%,
W: 0% to 1.00%,
Sn: 0% to 1.00%,
Sb: 0% to 0.20%,
Ca: 0% to 0.0100%,
Mg: 0% to 0.0100%,
Zr: 0% to 0.0100%, and
REM: 0% to 0.0100%, with the balance comprising Fe and impurities, wherein a metal micro-structure comprising 70 to 95% ferrite in volume fraction and 5 to 30% hard phases in volume fraction, a value X1 obtained by dividing a standard deviation of Vickers hardnesses $H_{1/4}$ at ¼ sheet-thickness positions by an average value of the Vickers hardnesses $H_{1/4}$ is 0.025 or less, and a value X2 obtained by dividing a standard deviation of Vickers hardnesses $H_{1/2}$ at a ½ sheet-thickness position by an average Value of the Vickers hardnesses $H_{1/2}$ is 0.030 or less.

* * * * *